US012121767B2

(12) United States Patent
Lagree et al.

(10) Patent No.: US 12,121,767 B2
(45) **Date of Patent: *Oct. 22, 2024**

(54) EXERCISE MACHINE HANDLE SYSTEM

(71) Applicant: Lagree Technologies, Inc., Chatsworth, CA (US)

(72) Inventors: Sebastien Anthony Louis Lagree, Chatsworth, CA (US); Samuel D. Cox, Yuba City, CA (US); Todd G. Remund, Yuba City, CA (US)

(73) Assignee: Lagree Technologies, Inc., Chatsworth (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/317,562

(22) Filed: May 15, 2023

(65) Prior Publication Data

US 2023/0285797 A1 Sep. 14, 2023

Related U.S. Application Data

(63) Continuation of application No. 17/944,488, filed on Sep. 14, 2022, now Pat. No. 11,684,818, which is a (Continued)

(51) Int. Cl.
*A63B 21/00* (2006.01)
*A63B 22/20* (2006.01)

(52) U.S. Cl.
CPC ..... *A63B 21/4035* (2015.10); *A63B 22/203* (2013.01); *A63B 2208/0214* (2013.01); *A63B 2225/09* (2013.01)

(58) Field of Classification Search
CPC ..... A63B 21/4033; A63B 21/4035; A63B 21/4045; A63B 21/4047; A63B 21/4049; (Continued)

(56) References Cited

U.S. PATENT DOCUMENTS 131,886 A 10/1872 Little
1,621,477 A 3/1927 Pilates
(Continued)

FOREIGN PATENT DOCUMENTS

KR 101099244 B1 12/2011
WO 2004096376 A1 11/2004

OTHER PUBLICATIONS

Picture of an Exercise Machine Product Developed by the Inventor, Sebastien Lagree; 2007.

(Continued)

*Primary Examiner* — Gary D Urbiel Goldner
(74) *Attorney, Agent, or Firm* — Neustel Law Offices

(57) ABSTRACT

An exercise machine handle system which provides for a plurality of exerciser positioning surfaces and gripping handles. The exercise machine handle system generally includes an exercise machine carriage and end platform handle system. The exercise machine carriage and end platform handle system includes a plurality of gripping features, thus allowing the exerciser to perform a substantially expanded repertoire of exercises using the exercise machine handle system. An exemplary embodiment of an exercise machine carriage and end platform system may include a carriage with a plurality of handles and a plurality of intermediate support members. In another exemplary embodiment, an exercise machine carriage and end platform system may include an end platform with a plurality of handles, a split carriage, and/or ladder step handles on a handle assembly.

20 Claims, 10 Drawing Sheets

Related U.S. Application Data continuation of application No. 16/869,864, filed on May 8, 2020, now Pat. No. 11,446,540.

(60) Provisional application No. 62/845,021, filed on May 8, 2019.

(58) Field of Classification Search
CPC ..... A63B 22/0046; A63B 22/0076; A63B 22/0087; A63B 22/0089; A63B 2022/0082; A63B 2022/0084; A63B 69/06; A63B 2069/064; A63B 2208/0214; A63B 2208/0242; A63B 2208/0247; A63B 2208/0252; A63B 2225/09
See application file for complete search history.

(56) References Cited

U.S. PATENT DOCUMENTS 1,866,868 A 7/1932 Thomson
2,223,309 A 4/1940 Swanson
3,589,720 A 6/1971 Agamian
3,746,338 A 7/1973 Proctor
3,770,267 A 11/1973 McCarthy
3,795,396 A 3/1974 Kropeinitski
3,806,094 A 4/1974 Harken
4,111,417 A 9/1978 Gardner
4,231,375 A 11/1980 Boehringer
4,541,627 A 9/1985 MacLean
4,620,701 A 11/1986 Mojden
4,625,962 A 12/1986 Street
4,650,184 A 3/1987 Brebner
4,695,050 A 9/1987 Smith
4,706,953 A 11/1987 Graham
4,709,918 A 12/1987 Grinblat
4,709,920 A 12/1987 Schnell
4,756,523 A 7/1988 Rasmussen
4,759,540 A 7/1988 Yu
4,798,378 A 1/1989 Jones
4,845,987 A 7/1989 Kenneth
4,865,317 A 9/1989 Hickey
4,911,438 A 3/1990 Van Straaten
4,915,377 A 4/1990 Malnke
5,007,632 A 4/1991 Wilkinson
5,064,189 A 11/1991 Shiuh-Shinn
5,066,005 A 11/1991 Luecke
5,072,929 A 12/1991 Peterson
5,108,093 A 4/1992 Watterson
5,139,471 A 8/1992 Domberger
5,179,746 A 1/1993 Rogers
5,211,617 A 5/1993 Millen
5,263,913 A 11/1993 Boren
5,295,935 A 3/1994 Wang
5,358,462 A 10/1994 Calderone
5,374,226 A 12/1994 Grahm
5,380,259 A 1/1995 Robertson
5,429,567 A 7/1995 Gerschefske
D362,700 S 9/1995 Breibart
5,503,609 A 4/1996 Bull
D382,319 S 8/1997 Gerschefske
5,681,249 A 10/1997 Endelman
5,833,588 A 11/1998 Connelly, III
5,857,946 A 1/1999 Brown
5,868,649 A 2/1999 Erickson
5,885,197 A 3/1999 Barton
5,967,955 A 10/1999 Westfall
5,997,450 A 12/1999 Wilkinson
6,042,523 A 3/2000 Graham
6,045,491 A 4/2000 McNergney
6,071,217 A 6/2000 Barnett
6,179,753 B1 1/2001 Barker
6,280,366 B1 8/2001 Hsieh
6,315,695 B1 11/2001 Foilett
6,440,045 B1 8/2002 Gaston
6,461,283 B1 10/2002 Maron
6,527,685 B2 3/2003 Endelman
6,634,996 B2 10/2003 Jacobsen
6,652,425 B1 11/2003 Martin
6,786,850 B2 9/2004 Nizamuddin
6,817,968 B2 11/2004 Galbraith
6,981,932 B1 3/2006 Huang
7,090,621 B2 8/2006 Loane
7,163,500 B2 1/2007 Endelman
7,294,098 B2 11/2007 Barnard
7,419,459 B2 9/2008 Van Straaten
7,438,673 B1 10/2008 Jones
7,654,941 B2 2/2010 Lacher
7,803,095 B1 9/2010 Lagree
7,806,805 B2 10/2010 Barufka
7,819,777 B1 10/2010 Service
7,931,570 B2 4/2011 Hoffman
7,942,799 B1 5/2011 Boyd
7,967,736 B2 6/2011 D'Silva
D659,205 S 5/2012 Endelman
8,249,714 B1 8/2012 Hartman
8,430,800 B2 4/2013 Nolan
8,500,611 B2 8/2013 Hoffman
8,585,554 B2 11/2013 Shavit
8,613,692 B2 12/2013 Baudhuin
8,641,585 B2 2/2014 Lagree
8,721,511 B2 5/2014 Endelman
8,834,332 B2 9/2014 Campanaro
8,894,551 B2 11/2014 Kerdjoudj
8,961,373 B2 2/2015 Halver
9,022,909 B2 5/2015 Kermath
9,072,931 B2 7/2015 Lagree
9,079,071 B2 7/2015 Allain
9,119,989 B1 9/2015 Lagree
9,138,606 B2 9/2015 Lagree
9,180,332 B1 11/2015 Tenorio
9,211,440 B2 12/2015 Lagree
9,283,422 B2 3/2016 Lagree
9,289,645 B2 3/2016 Masterson
9,393,454 B2 7/2016 Lagree
9,415,253 B2 8/2016 Lagree
9,604,095 B1 3/2017 Lagree
9,789,354 B2 10/2017 Lagree
9,827,458 B2 11/2017 Dalton
10,046,193 B1 8/2018 Aronson
10,201,724 B2 12/2019 Lagree
10,857,418 B2 12/2020 Lagree
11,161,001 B1 11/2021 Lagree
11,298,284 B2 4/2022 Bayerlein
11,446,540 B2 9/2022 Lagree
2001/0056011 A1 12/2001 Endelman
2002/0058573 A1 5/2002 Endelman
2003/0119635 A1 6/2003 Arbuckle
2004/0009849 A1 1/2004 Galbraith
2004/0043873 A1 3/2004 Wilkinson
2004/0142800 A1 7/2004 Gerschefske
2005/0085357 A1 4/2005 Endelman
2005/0124471 A1 6/2005 Wilkinson
2005/0130810 A1 6/2005 Sands
2005/0164856 A1 7/2005 Parmater
2006/0046914 A1 3/2006 Endelman
2006/0183606 A1 8/2006 Parmater
2006/0199712 A1 9/2006 Barnard
2007/0087921 A1 4/2007 Graham
2007/0117693 A1 5/2007 Illio
2007/0129226 A1 6/2007 Leavitt
2007/0219053 A1 9/2007 Barufka
2008/0070765 A1 3/2008 Brown
2008/0248935 A1 10/2008 Solow
2009/0111661 A1 4/2009 Hauser
2009/0118108 A1 5/2009 Uygan
2010/0227748 A1 9/2010 Campanaro
2011/0009249 A1 1/2011 Campanaro
2011/0130258 A1 6/2011 Gerschefske
2011/0143898 A1 6/2011 Trees
2011/0152036 A1 6/2011 Halver
2011/0166002 A1 7/2011 Savsek
2011/0172069 A1 7/2011 Gerschefske
2012/0295771 A1 11/2012 Lagree
2013/0017935 A1 1/2013 Endelman
2013/0150216 A1 6/2013 Bell

(56) References Cited

U.S. PATENT DOCUMENTS

| | | | |
|---|---|---|---|
| 2013/0196835 | A1 | 8/2013 | Solow |
| 2013/0281269 | A1 | 10/2013 | Gerschefske |
| 2014/0011645 | A1 | 1/2014 | Johnson |
| 2014/0100089 | A1 | 4/2014 | Kermath |
| 2014/0121076 | A1 | 5/2014 | Lagree |
| 2014/0121078 | A1 | 5/2014 | Lagree |
| 2014/0121079 | A1 | 5/2014 | Lagree |
| 2014/0141948 | A1 | 5/2014 | Aronson |
| 2014/0221182 | A1 | 8/2014 | Lin |
| 2015/0024914 | A1 | 1/2015 | Lagree |
| 2015/0057127 | A1 | 2/2015 | Lagree |
| 2015/0065318 | A1 | 3/2015 | Lagree |
| 2015/0065320 | A1 | 3/2015 | Anderson |
| 2015/0072841 | A1 | 3/2015 | Lagree |
| 2015/0141204 | A1 | 5/2015 | Lagree |
| 2015/0217164 | A1 | 8/2015 | Lagree |
| 2015/0220523 | A1 | 8/2015 | Lagree |
| 2015/0246258 | A1 | 9/2015 | Hockridge |
| 2015/0246263 | A1 | 9/2015 | Campanaro |
| 2015/0297944 | A1 | 10/2015 | Lagree |
| 2015/0343250 | A1 | 12/2015 | Lagree |
| 2015/0360068 | A1 | 12/2015 | Lagree |
| 2015/0360083 | A1 | 12/2015 | Lagree |
| 2015/0360113 | A1 | 12/2015 | Lagree |
| 2015/0364058 | A1 | 12/2015 | Lagree |
| 2015/0367166 | A1 | 12/2015 | Lagree |
| 2016/0008657 | A1 | 1/2016 | Lagree |
| 2016/0059060 | A1 | 3/2016 | Lagree |
| 2016/0059061 | A1 | 3/2016 | Lagree |
| 2016/0096059 | A1 | 4/2016 | Lagree |
| 2016/0166870 | A1 | 6/2016 | Lagree |
| 2016/0193496 | A1 | 7/2016 | Lagree |
| 2016/0256733 | A1 | 9/2016 | Lagree |
| 2016/0271452 | A1 | 9/2016 | Lagree |
| 2016/0317858 | A1 | 11/2016 | Lagree |
| 2016/0317863 | A1 | 11/2016 | Goldberg |
| 2016/0346593 | A1 | 12/2016 | Lagree |
| 2016/0361602 | A1 | 12/2016 | Lagree |
| 2017/0014664 | A1 | 1/2017 | Lagree |
| 2017/0014672 | A1 | 1/2017 | Lagree |
| 2017/0036057 | A1 | 2/2017 | Lagree |
| 2017/0036061 | A1 | 2/2017 | Lagree |
| 2017/0043210 | A9 | 2/2017 | Lagree |
| 2017/0065846 | A1 | 3/2017 | Lagree |
| 2017/0072252 | A1 | 3/2017 | Lagree |
| 2017/0080287 | A1 | 3/2017 | Jaquish |
| 2017/0087397 | A1 | 3/2017 | Lagree |
| 2017/0100625 | A1 | 4/2017 | Lagree |
| 2017/0100629 | A1 | 4/2017 | Lagree |
| 2017/0106232 | A1 | 4/2017 | Lagree |
| 2017/0113091 | A1 | 4/2017 | Lagree |
| 2017/0120101 | A1 | 5/2017 | Lagree |
| 2017/0144013 | A1 | 5/2017 | Lagree |
| 2017/0157452 | A1 | 6/2017 | Lagree |
| 2017/0157458 | A1 | 6/2017 | Lagree |
| 2017/0165518 | A1 | 6/2017 | Lagree |
| 2017/0165555 | A1 | 6/2017 | Lagree |
| 2017/0189740 | A1 | 7/2017 | Lagree |
| 2017/0189741 | A1 | 7/2017 | Lagree |
| 2017/0209728 | A1 | 7/2017 | Lagree |
| 2017/0239526 | A1 | 8/2017 | Lagree |
| 2017/0246491 | A1 | 8/2017 | Lagree |
| 2017/0246499 | A1 | 8/2017 | Lagree |
| 2017/0296865 | A1 | 10/2017 | Lagree |
| 2017/0304673 | A1 | 10/2017 | Lagree |
| 2017/0326406 | A1 | 11/2017 | Lagree |
| 2017/0340947 | A1 | 11/2017 | Lagree |
| 2017/0354840 | A1 | 12/2017 | Lagree |
| 2018/0015319 | A1 | 1/2018 | Lagree |
| 2018/0021621 | A1 | 1/2018 | Lagree |
| 2018/0021655 | A1 | 1/2018 | Lagree |
| 2018/0036583 | A1 | 2/2018 | Lagree |
| 2018/0056109 | A1 | 3/2018 | Lagree |
| 2018/0056133 | A1 | 3/2018 | Lagree |
| 2018/0111020 | A1 | 4/2018 | Lagree |
| 2018/0111033 | A1 | 4/2018 | Lagree |
| 2018/0117392 | A1 | 5/2018 | Lagree |
| 2018/0133532 | A1 | 5/2018 | Lagree |
| 2018/0133533 | A1 | 5/2018 | Lagree |
| 2018/0133534 | A1 | 5/2018 | Lagree |
| 2018/0133542 | A1 | 5/2018 | Lagree |
| 2018/0178053 | A1 | 6/2018 | Lagree |
| 2018/0193691 | A1 | 7/2018 | Lagree |
| 2018/0250551 | A1 | 9/2018 | Lagree |
| 2018/0250573 | A1 | 9/2018 | Lagree |
| 2018/0272179 | A1 | 9/2018 | Lagree |
| 2018/0280782 | A1 | 10/2018 | Lagree |
| 2018/0318627 | A1 | 11/2018 | Lagree |
| 2018/0318646 | A1 | 11/2018 | Lagree |
| 2018/0326242 | A1 | 11/2018 | Jaquish |
| 2018/0326252 | A1 | 11/2018 | Lagree |
| 2018/0353803 | A1 | 12/2018 | Lagree |
| 2018/0361190 | A1 | 12/2018 | Lagree |
| 2018/0361197 | A1 | 12/2018 | Lagree |
| 2019/0083842 | A1 | 3/2019 | Lagree |
| 2019/0160320 | A1 | 5/2019 | Lagree |
| 2019/0160329 | A1 | 5/2019 | Lagree |
| 2019/0232105 | A1 | 8/2019 | Lagree |
| 2019/0240530 | A1 | 8/2019 | Lagree |
| 2019/0247694 | A1 | 8/2019 | Lagree |
| 2019/0247705 | A1 | 8/2019 | Lagree |
| 2019/0247707 | A1 | 8/2019 | Lagree |
| 2019/0255375 | A1 | 8/2019 | Lagree |
| 2019/0269961 | A1 | 9/2019 | Lagree |
| 2019/0314672 | A1 | 10/2019 | Lagree |
| 2019/0358484 | A1 | 11/2019 | Lagree |
| 2020/0030657 | A1 | 1/2020 | Lagree |
| 2020/0047051 | A1 | 2/2020 | Lagree |
| 2020/0054913 | A1 | 2/2020 | Lagree |
| 2020/0078630 | A1 | 3/2020 | Lagree |
| 2020/0078634 | A1 | 3/2020 | Lagree |
| 2020/0222741 | A1 | 7/2020 | Aronson |
| 2020/0353306 | A1 | 11/2020 | Lagree |
| 2021/0220694 | A1 | 7/2021 | Lagree |
| 2022/0062697 | A1 | 3/2022 | Lagree |
| 2023/0019435 | A1* | 1/2023 | Lagree ..... A63B 21/4035 |

OTHER PUBLICATIONS

Picture of PROFORMER Exercise Machine; Dec. 31, 2008.

https://web.archive.org/web/20100501142110/http:/spxfitness.com/index.php?option=com_content&view=article&id=32&Itemid=3; SPX Fitness Superformer Wayback Machine Archive.org Page; May 1, 2010.

Pictures of Megaformer M2 Exercise Machine Developed by the Inventor, Sebastien Lagree; Jan. 1, 2011.

Pictures of Megaformer Product Developed by the Inventor, Sebastien Lagree; Printed.

https://web.archive.org/web/20121205030242/http:/www.lagreefitness.com:80/index.php?option=com_content&view=article&id=32&Itemid=3; Lagree Fitness Wayback Machine Archive.org Page; Dec. 5, 2012.

https://web.archive.org/web/20160405173247/http://static.flickr.com/8480/8186598268_8390c9bc08_b.jpg; MegaFormer M3 Picture Wayback Machine Archive.org Page; Dec. 5, 2012.

Https://Twitter.Com/LagreeFitness/Status/635822521997242369; "Can You Handle The Supraformer?" (@LAGREEFITNESS) Twitter Post; Aug. 24, 2015.

Https://Twitter.Com/LagreeFitness/Status/636555280218615808; "Los Angeles: Get Ready For A One Of Kind Workout!" (@LAGREEFITNESS) Twitter Post; Aug. 26, 2015.

PCT International Search Report and Written Opinion for PCT/US2016/58178; Jan. 13, 2017.

Pictures of Megaformer M3 Exercise Machine Developed by the Inventor, Sebastien Lagree; Dec. 15, 2012.

* cited by examiner

EXERCISE MACHINE HANDLE SYSTEM

CROSS REFERENCE TO RELATED APPLICATIONS

The present application is a continuation of U.S. application Ser. No. 17/944,488 filed on Sep. 14, 2022, which is a continuation of U.S. Application Ser. No. 16/869,864 filed on May 8, 2020 now issued as U.S. Pat. No. 11,446,540, which claims priority to U.S. Provisional Application No. 62/845,021 filed May 8, 2019. Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an exercise machine carriage and end platform handle system which provides for a plurality of exerciser positioning surfaces and gripping handles.

RELATED ART

Any discussion of the related art throughout the specification should in no way be considered as an admission that such related art is widely known or forms part of common general knowledge in the field.

Those skilled in the art will appreciate that traditional resistance exercise machines with a slidable, substantially horizontal exercise platform, such as a Pilates apparatus or reformer, are intended to provide for resistance training by moving the platform reciprocally along one or more longitudinal rails that guide the platform's linear movement during exercise. Traditionally, such apparatuses fail to provide the exerciser with multiple gripping options on the reciprocating platform or structure, thereby preventing the performance of many beneficial exercises upon the apparatus.

SUMMARY

An example embodiment is directed to an exercise machine carriage and end platform handle system. The exercise machine carriage and end platform handle system which includes a plurality of gripping features, thus allowing the exerciser to perform a substantially expanded repertoire of exercises upon the apparatus.

An exemplary embodiment of an exercise machine carriage and end platform system may include a carriage with a plurality of handles and a plurality of intermediate support members. In another exemplary embodiments, an exercise machine carriage and end platform system may comprise an end platform with a plurality of handles, a split carriage, and/or ladder step handles on a handle assembly.

There has thus been outlined, rather broadly, some of the embodiments of the exercise machine handle system in order that the detailed description thereof may be better understood, and in order that the present contribution to the art may be better appreciated. There are additional embodiments of the exercise machine handle system that will be described hereinafter and that will form the subject matter of the claims appended hereto. In this respect, before explaining at least one embodiment of the exercise machine handle system in detail, it is to be understood that the exercise machine handle system is not limited in its application to the details of construction or to the arrangements of the components set forth in the following description or illustrated in the drawings. The exercise machine handle system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments" is not exhaustive and does not require that all embodiments include the discussed feature, advantage or mode of operation. The words "rotate", "rotated", "rotating", "rotatable" and "rotatably" are used herein interchangeably with the terms "pivot", "pivoted", "pivoting", "pivotable" and "pivotably".

Although more than one embodiment is illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations, derivations or variations of the embodiments discussed herein.

It should be noted that the machine described herein comprises features and designs on opposed sides of a central longitudinal axis that are substantially mirror images in form and function. The description of any components, assemblies or particular features of the machine which are described on one side of the center line parallel to the longitudinal axis would preferably apply to the similar components, assemblies or particular features on the opposed side of the machine.

Figure 1:
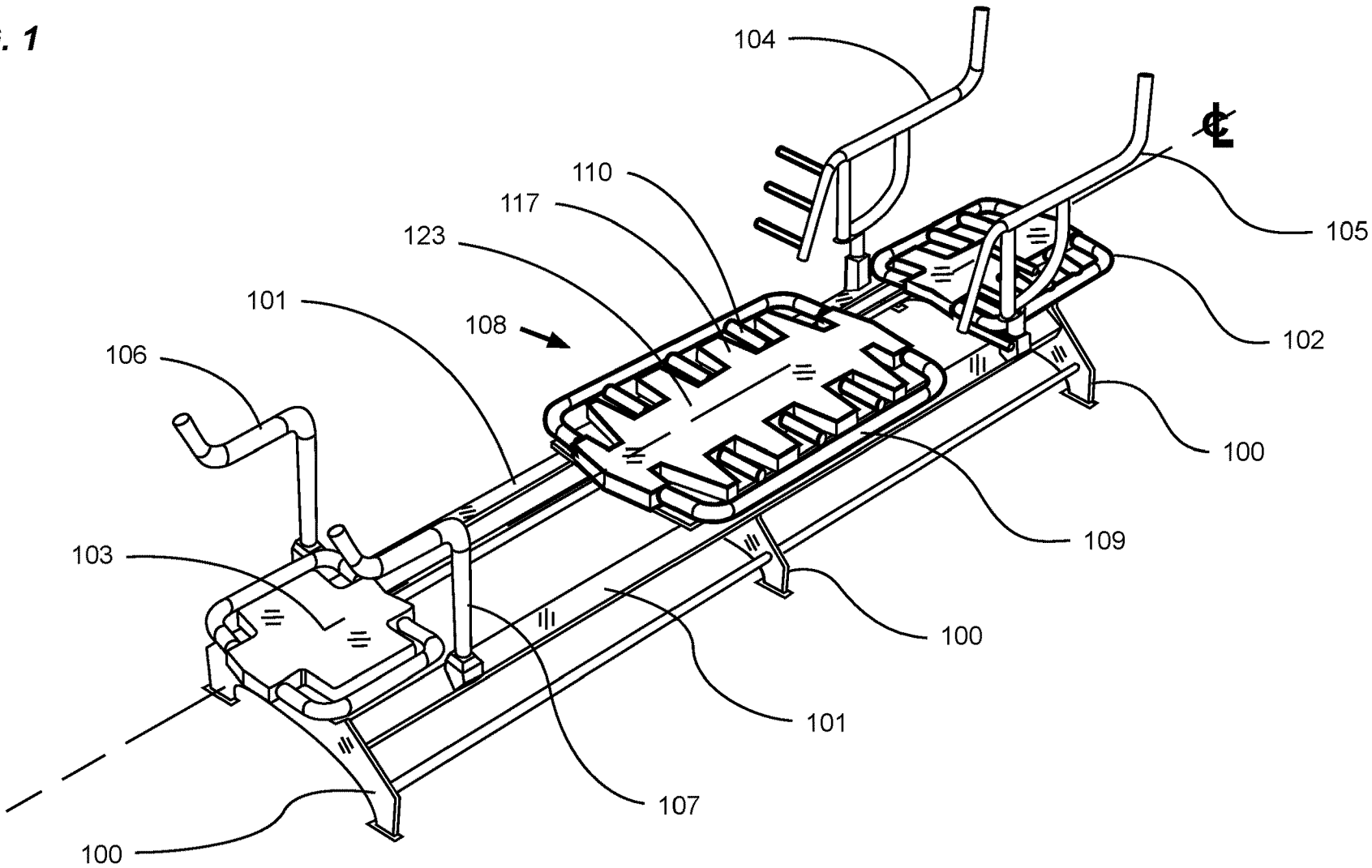
FIG. 1 is an exemplary diagram showing an isometric view of an embodiment of an exercise machine with a plurality of support platforms and gripping handles.

FIG. 1 is an exemplary diagram showing an isometric view of an embodiment of an exercise machine with a plurality of support platforms and gripping handles. The drawing shows an exemplary embodiment of an embodiment of an exercise machine with a support structure comprising a plurality of base support members 100, one or more guide rails 101, a stationary exercise platform 102 at a first end, a stationary exercise platform 103 at a distal second end, a first end left handle assembly 104, a first end right handle assembly 105, a second end left handle assembly 106 and a second end right handle assembly 107.

A slidable carriage 108 may be movably attached to the pair of parallel guide rails by any number of manners, such as wheel trollies and the like, but which provide for the slidable carriage 108 to roll longitudinally upon and substantially the length of the guide rails 101 between the first end stationary platform 102 and second end stationary platform 103. The slidable carriage provides for a plurality of gripping members including a plurality of inner carriage handles 110 and a plurality of outer carriage handles 109 which substantially encircle the slidable carriage exercise platform 123. The slidable carriage 108 may be moved along the guide rails 101 in opposition to one or more biasing members 200, the biasing members 200 providing a resistance force against the slidable carriage 108 which must be overcome by muscular force of the exerciser in order to slide in a direction opposed to the direction of the biasing force.

A plurality of gripping handles 110 are shown affixed to the slidable carriage structure 108, with the central axis of the handles 110 substantially transverse to the machine's longitudinal axis, with the upper surface of the handles 110 substantially coplanar with the upper surface plane of the slidable carriage exercise platform 123. The handles 109, 110 may be interposed between laterally projecting portions 117 of the exercise platform 123.

Figure 2:
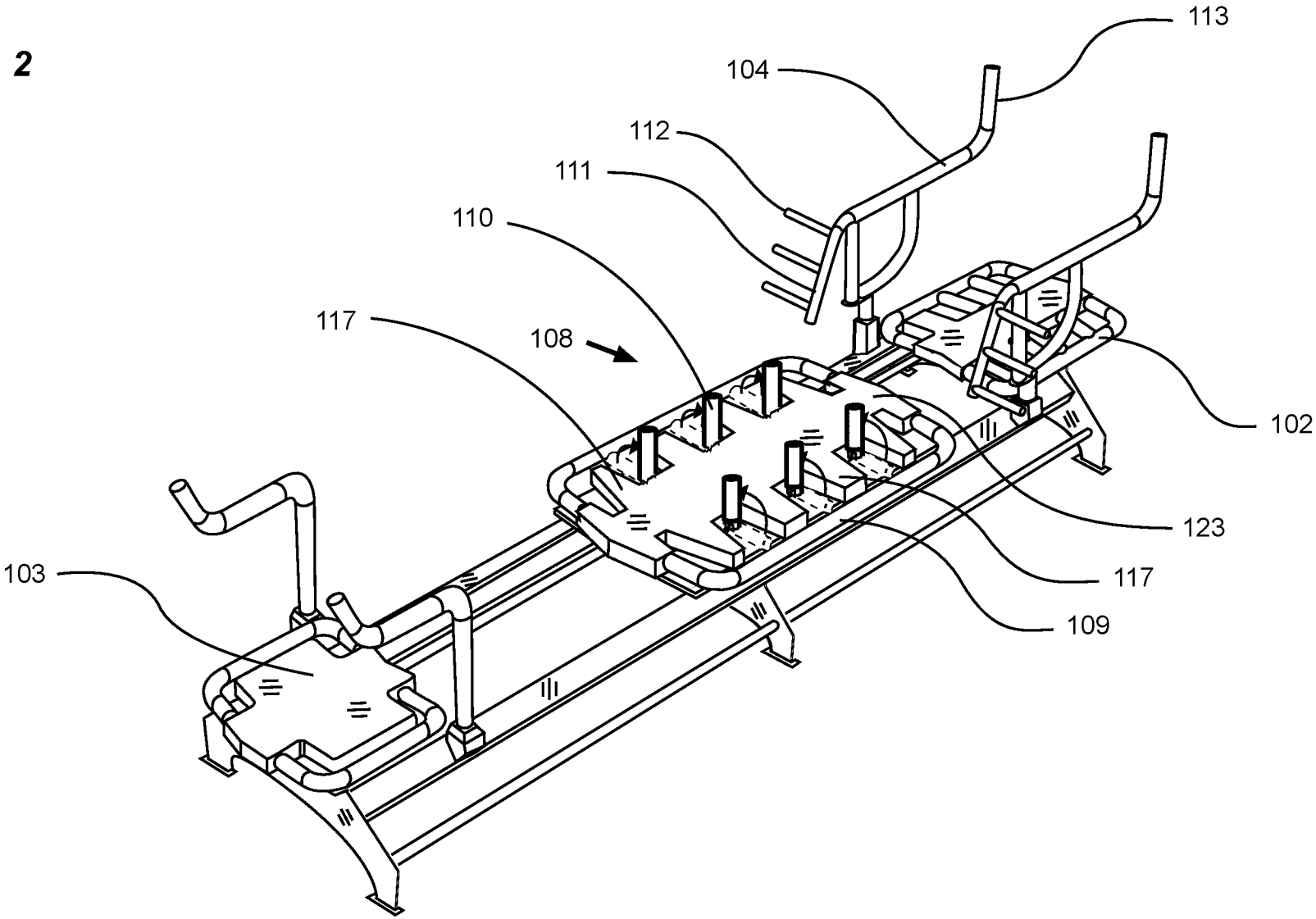
FIG. 2 is an exemplary diagram showing an isometric view of an embodiment of an exercise machine with a plurality of support platforms and an alternate handle arrangement.

FIG. 2 is an exemplary diagram showing an isometric view of an embodiment of an exercise machine with a plurality of support platforms 102, 103 and an alternate handle arrangement. The drawing shows an embodiment of an exercise machine with a base support members 100 and guide rails 101, a stationary exercise platform 102 at a first end, a stationary exercise platform 103 at a distal second end, a first end left handle assembly 104, a first end right handle assembly 105, a second end left handle assembly 106 and a second end right handle assembly 107. A slidable carriage 108 as just described provides for a plurality of inner carriage handles 110 and an outer carriage handle 109 encircling substantially the opposed sides of the slidable carriage exercise platform.

In the exemplary embodiment of FIG. 2, it can be seen that a plurality of inner carriage handles 110 are interposed between a plurality of laterally projecting portions 117 of the slidable carriage platform 123. The laterally projecting portions 117 are illustrated as comprising spaced-apart projections which extend laterally from the carriage 108. The outer carriage handle 109 is illustrated as extending around the laterally projecting portions 117 on either side of the carriage 108.

FIG. 1 illustrates that the inner carriage handles 110 may extend along the same plane as the carriage 108 upper surface along a laterally transverse axis to the machine. FIG. 2 illustrates an embodiment in which the inner carriage handles 110 have been rotated so as to extend perpendicularly with respect to the upper surface of the carriage 108. The inner carriage handles 110 of the novel variation shown in FIG. 2 are illustrated as being rotatably affixed to the slidable carriage 108 structure thereby providing the exerciser the option of rotating the central axis of one or more of the inner carriage handles 110 from a laterally transverse axis relative to the longitudinal axis of the machine, to a substantially vertical axis for the performance of certain exercises.

The number of inner carriage handles 110 may vary in different embodiments. The inner carriage handles 110 are illustrated as comprising substantially cylindrical members which may or may not be padded. It should be appreciated that other shapes and sizes may be utilized to suit different applications. The shape, size, orientation, and number of inner carriage handles 110 shown in the exemplary embodiments of the figures thus should not be construed as limiting in scope.

Continuing to reference FIG. 2, the improved exercise machine may comprise a first end left handle assembly 104 and a first end right handle assembly 105 providing substantially a mirror image of the left handle assembly 104 in form and function. A plurality of ladder rungs 112 are shown affixed to a ladder rail 111. As shown, each of the ladder rungs 112 may project laterally from the ladder rail 111. In the exemplary embodiment of FIG. 2, the ladder rungs 112 are shown extending perpendicularly with respect to the ladder rail 111. It should be appreciated that various other angles of projection may be utilized in different embodiments.

The ladder rungs 112 are illustrated as comprising elongated, rod-like members which extend from the ladder rail 111. The spacing, orientation, size, and number of ladder rungs 112 may vary in different embodiments and thus should not be construed as limited by the exemplary figures. More or less ladder rungs 112 may be utilized to suit different applications. Further, the ladder rungs 112 may be fixedly, integrally, or removably connected to the ladder rail 111, which itself may be fixedly, integrally, or removably connected to the respective handle assembly 104, 105.

The ladder rail 111 is shown in FIG. 2 as comprising an elongated member which extends from each of the handle assemblies 104, 105. The figures illustrates that the ladder rail 111 extends toward the second end of the machine in an angular manner. It should be appreciated that the ladder rail 111 may extend in different directions, angles, or orientations in different embodiments.

The plurality of rungs 112 may be positioned to provide gripping surfaces at different elevations relative to the horizontal plane of the slidable carriage exercise platform 123. Exercisers gripping the lowest rungs 112 on the right and left handle assemblies 104, 105 with their respective right and left hands may engage different muscles and muscle groups by walking their hands up progressively elevated rungs 112. The left handle assembly 104 provides for yet another gripping surface, more specifically a riser handle 113 proximate to the first end of the machine for use by exercisers positioned upon the first end stationary platform 102.

Figure 3:
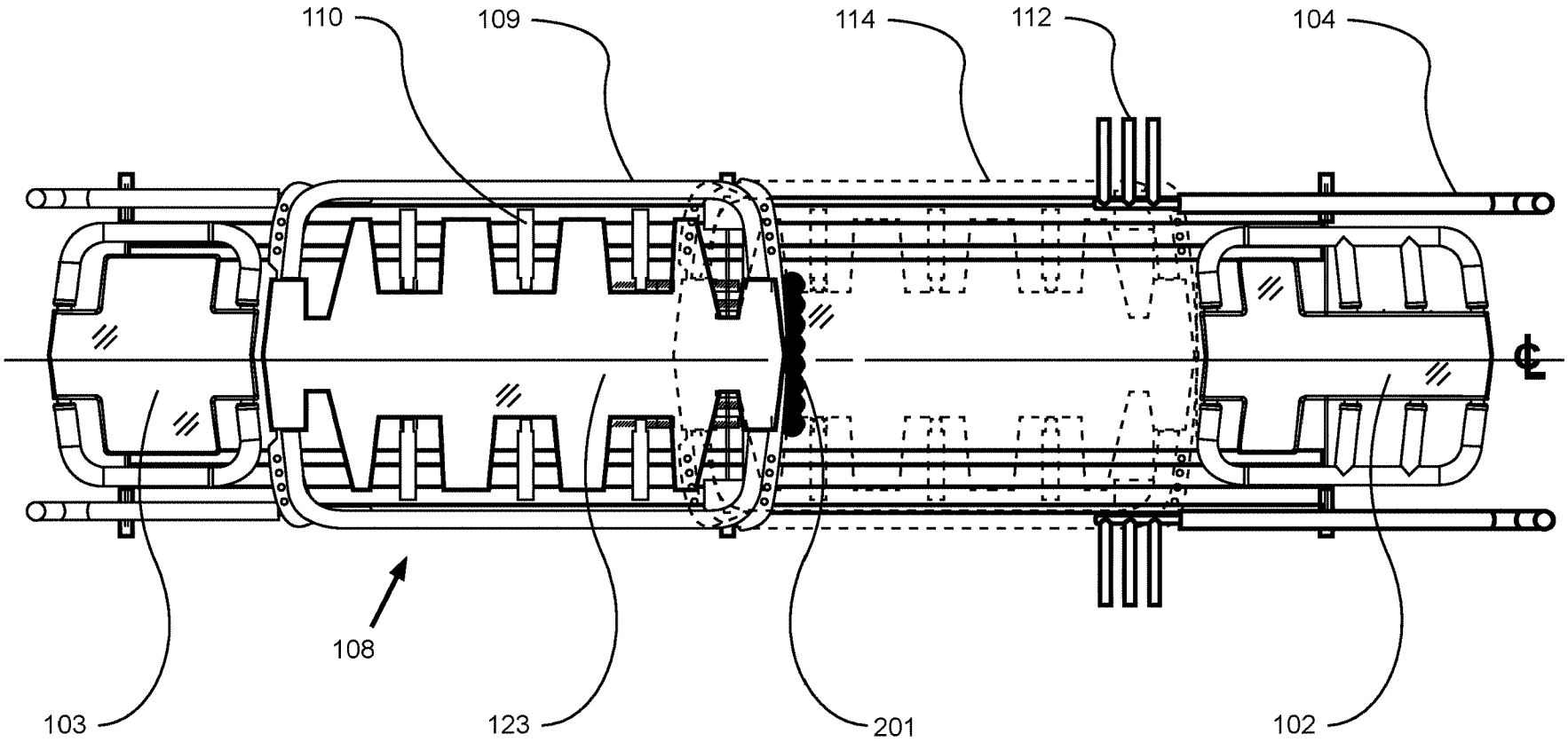
FIG. 3 is an exemplary diagram showing a top view of an embodiment of an exercise machine.

FIG. 3 is an exemplary diagram showing a top view of an embodiment of an exercise machine. A centerline indicator (CL) is shown aligned with the longitudinal axis of the machine. Features and functions described on one side of the centerline are provided on the opposed side of the machine as mirror images of those features and functions.

Continuing to reference FIG. 3, the machine comprises a first end stationary platform 102 and a second end stationary platform 103. A first end left handle assembly 104 comprises at least a plurality of ladder rungs 112 projecting laterally from the ladder rail 111, the central axis of the ladder rungs 112 being substantially transverse to the longitudinal center axis of the machine. A slidable carriage 108 is shown positioned proximate to the second end stationary platform 103, the default position when one or more biasing members 200 are engaged with the biasing member selector 201.

The biasing members 200 will be subsequently described in more detail. To move the slidable carriage toward the distal first end, for instance, to a position of the repositioned carriage 114 indicated by the dotted line, the exerciser must exert a horizontal force against the carriage 108 towards the distal first end of the machine sufficient to overcome the resistance force exerted on the carriage 108 that is biased toward the second end of the machine.

A plurality of inner carriage handles 110 are shown interposed between laterally projecting portions 117 of the slidable carriage exercise platform 123. An outer platform handle 109 encircles the laterally projecting portions 117 and provides for a gripping structure along the perimeter of the lateral sides of the carriage 108.

Figure 4:
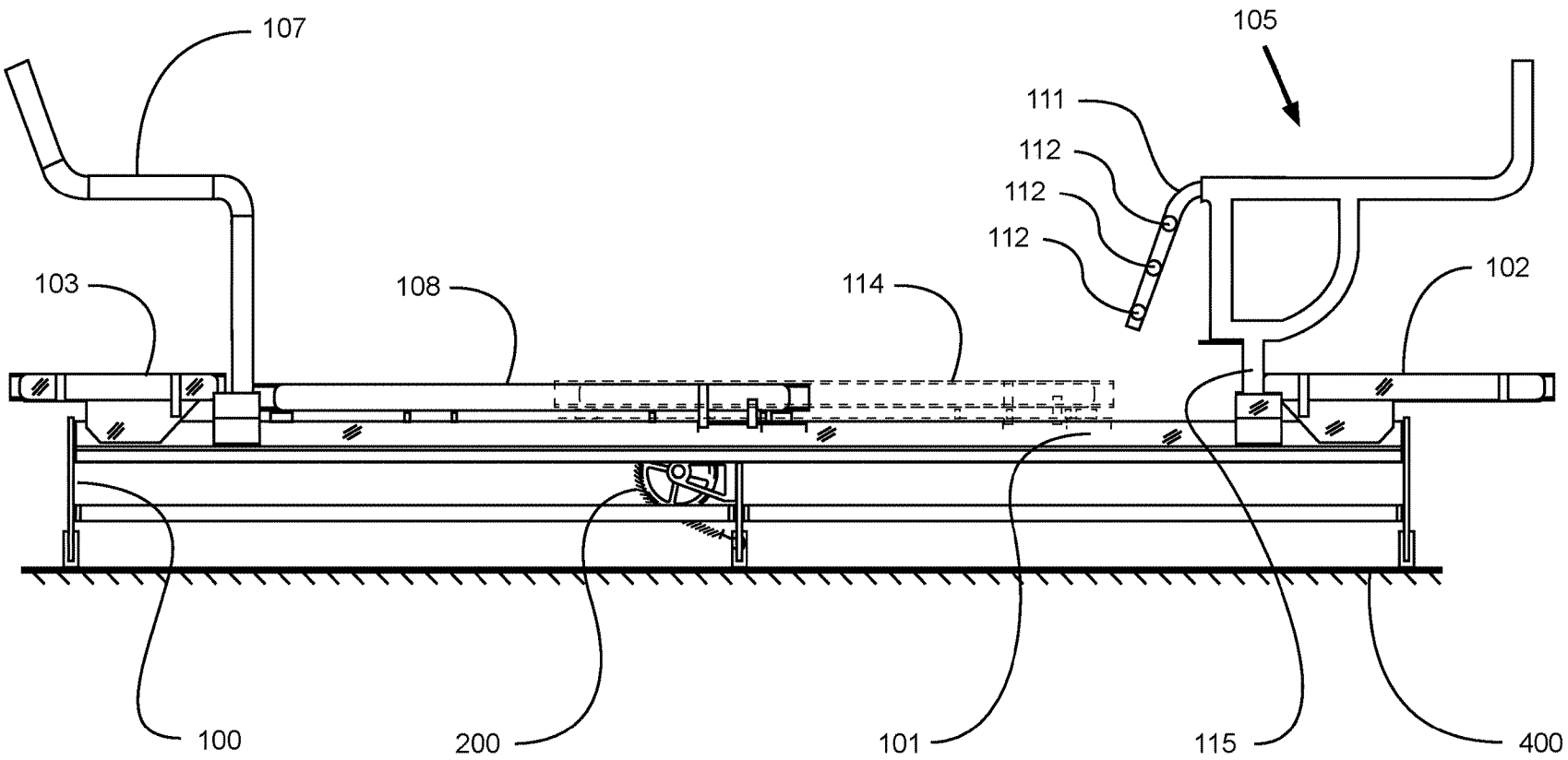
FIG. 4 is an exemplary diagram showing a side view of an embodiment of an exercise machine.

FIG. 4 is an exemplary diagram showing a side view of an embodiment of an exercise machine. In the drawing, an embodiment of an exercise machine is preferably positioned on a flat horizontal surface, for instance, a floor 400. The upper structure of the machine is affixed to the base support members 100 as previously described, the upper structure comprising a first end stationary platform 102, a second end stationary platform 103, a pair of parallel guide rails 101 extending substantially between the first end and second end stationary platforms 103, and a slidable carriage 108 movably affixed to the guide rails 101.

The slidable carriage 108 is therefore repositionable continuously along the guide rails 101, for instance, to a repositioned carriage 108 location indicated by the dashed line 114. A pair of second end handle assemblies 107 are affixed proximate to the second end stationary platform 103, and a pair of first end handle assemblies 105 are affixed proximate to the first end stationary platform 102, the handles 104, 105, 106, 107 being supported by one or more stanchion structures 115 affixed to the upper machine structure. The first end handle assemblies 105 provide for at least a substantially horizontal gripping portion aligned parallel to the longitudinal axis of the machine, a ladder rail 111, and a plurality of ladder rungs 112 projecting laterally from the ladder rail.

Figure 5:
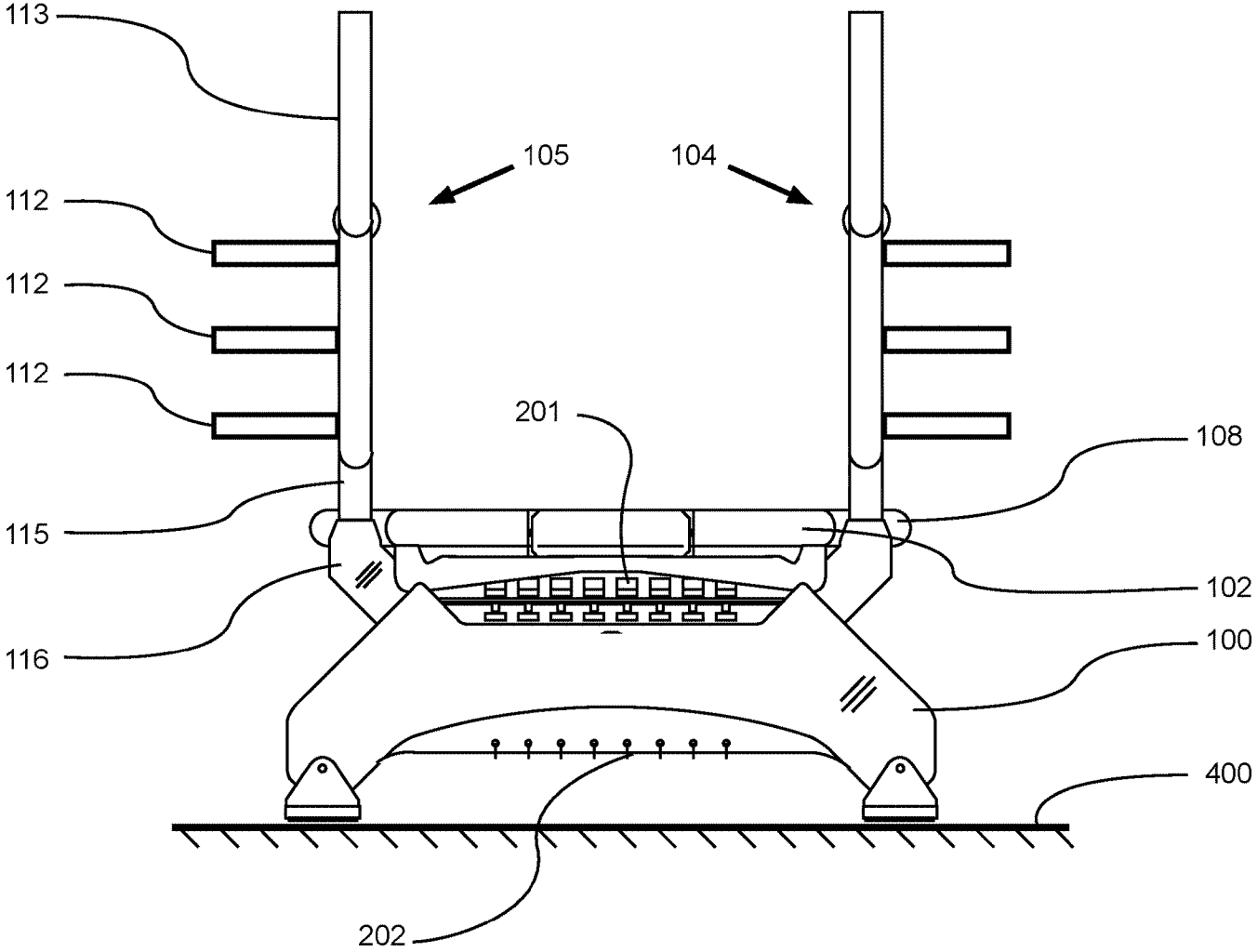
FIG. 5 is an exemplary diagram showing one end view of an embodiment of an exercise machine.

FIG. 5 is an exemplary diagram showing one end view of an embodiment of an exercise machine. In the drawing, an embodiment of an exercise machine is preferably positioned on a flat horizontal surface, for instance, a floor 400. The upper structure of the machine is affixed to the base support members 100 as previously described, the upper structure comprising a proximate first end stationary platform 102, and a slidable carriage 108. A first end right handle assembly 105 is supported by a stanchion structure 115, the lower portion of the stanchion structure affixed to the upper machine structure by means of a stanchion mount 116. A first end left handle assembly 104 is substantially a mirror of the right handle assembly 105. The proximate first end handle assemblies 104, 105 therefore comprise a proximate handle riser 113, a substantially horizontal gripping portion as previously described, and a plurality of ladder rungs 112 projecting laterally from the ladder rail 111.

As can be readily seen, the ladder rungs 112 are spaced apart to allow for easy gripping by an exerciser's hand, the vertical dimension between the floor 400 and the lower ladder rungs 112, and the floor 400 and the higher ladder rungs 112 therefore increase at a preferred interval.

Continuing to reference FIG. 5, a plurality of biasing member selectors 201 are shown on the proximate end of the slidable carriage 108. As will be subsequently described in more detail, each biasing member selector 201 terminates one end of a biasing member 200, with the opposed end of the biasing member 200 affixed to a stationary biasing member anchor gusset 202.

Figure 6:
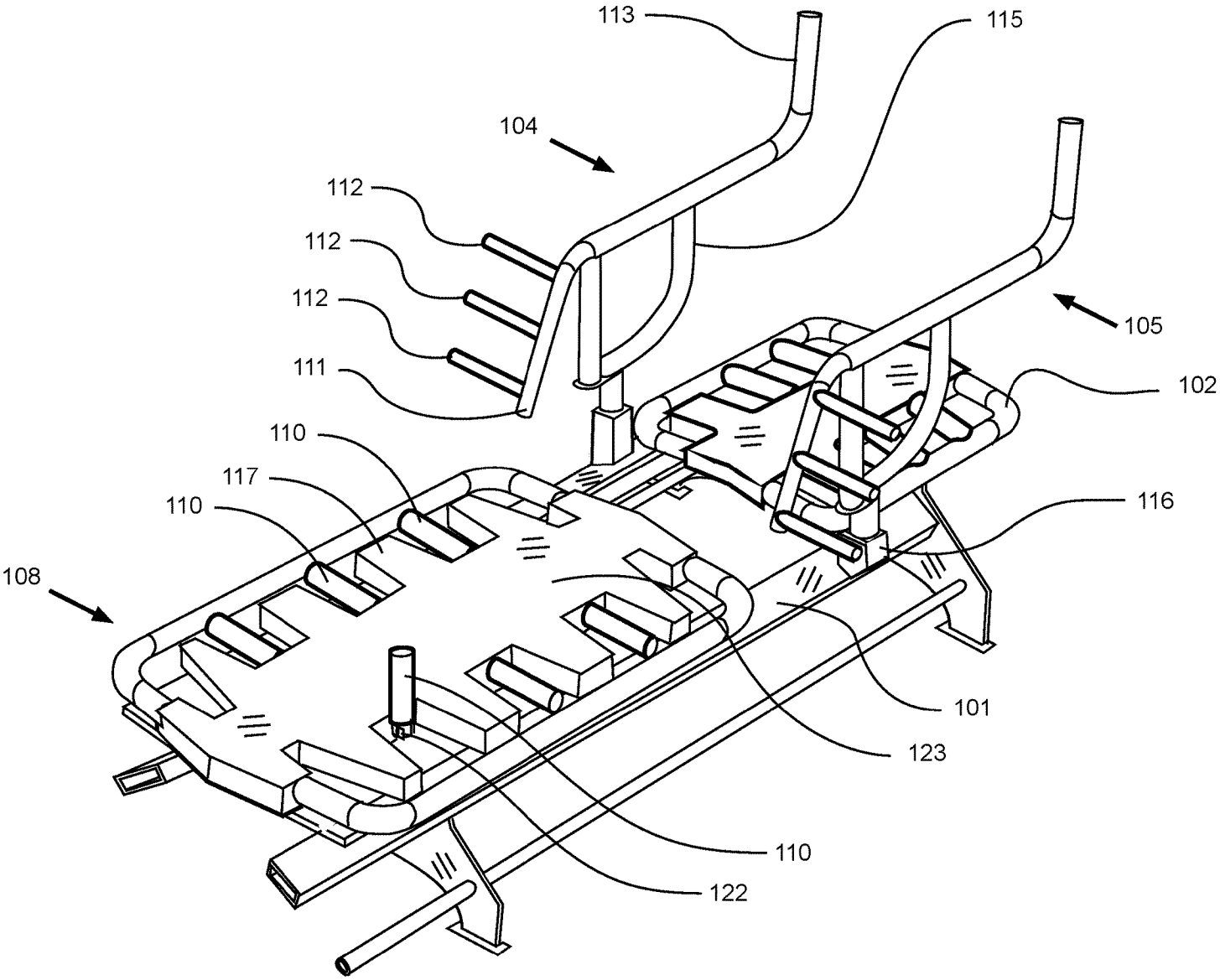
FIG. 6 is an exemplary diagram showing a close up isometric view of an embodiment of an exercise machine with a plurality of platforms and gripping handles.

FIG. 6 is an exemplary diagram showing a close up isometric view of an embodiment of an exercise machine with a plurality of platforms 102, 103 and gripping handles 104, 105, 106, 107. More specifically, the previously described second end of the improved exercise machine has been removed to allow a more detailed description of the slidable carriage 108 and first end of the machine.

FIG. 6 illustrates a portion of the parallel guide rails 101 to which the slidable carriage 108 is movably affixed. Further, a first end stationary exercise platform 102 is shown at a first end proximate to a first end left handle assembly 104 and a first end right handle assembly 105, the left and right handle assemblies 104, 105 being substantially mirror images of each other.

A slidable carriage 108 provides for a plurality of inner carriage handles 110 interposed between a plurality of lateral projections 117 of the slidable carriage exercise platform 123. As one variation of inner carriage handle 110 positioning, one handle 110 rotatably affixed to a mounting yoke 122 is shown rotated about the yoke 122 so that the laterally projecting, substantially horizontal central axis of the handle 110 is repositioned to a vertically projecting position above the top surface of the slidable carriage platform 123. Vertically projecting carriage handles 110 provide for exerciser use during exercises they would otherwise be unable to performable without the vertically projecting gripping structure.

It should be noted that although the drawing shows three inner carriage handles 110 interposed between four laterally projecting portions 117 of the slidable carriage exercise platform 123, the scope should not be limited to three handles 110 and four platform projections 117, as more or fewer handles 110 and platform projections 117 may be used. The figures illustrate that the handles 110 and projections 117 on one side of the slidable carriage 108 centerline are mirrored on the opposed side of the carriage 108 centerline. Other configurations could be utilized in alternate embodiments.

Further, a first end left handle assembly 104, and a first end right handle assembly 105 is shown, the handle assemblies 104, 105 being substantially mirror images of one another with the handles 104, 105 being supported by a stanchion structure 115, and the lower portion of the stanchion structure 115 being affixed to the upper machine structure by a stanchion mount 116. The handle assemblies 104, 105 provide for multiple hand gripping positions including a handle riser 113 at the distal portion of the assembly, an extended substantially horizontal bar portion with a central axis aligned parallel to the longitudinal axis of the machine, and a downwardly angled ladder rail 111 to which a plurality of spaced-apart ladder rungs 112 are affixed.

The plurality of hand gripping structures positioned at incremental vertical elevations above the slidable carriage exercise platform 123, and incremental horizontal dimensions as measured parallel to the longitudinal axis of the machine allow an exerciser positioned on the slidable carriage 108 with the ability to alternately change hand positions while pulling the slidable carriage 108 increasingly closer to the first end stationary platform 102 against the increasing resistance force created by the biasing members 200, and to confidently control reversing the sliding direction of the slidable carriage 108 in a direction away from the first end stationary platform 102 in response to the force created on the slidable carriage 108 by the biasing members 200.

Figure 7A:
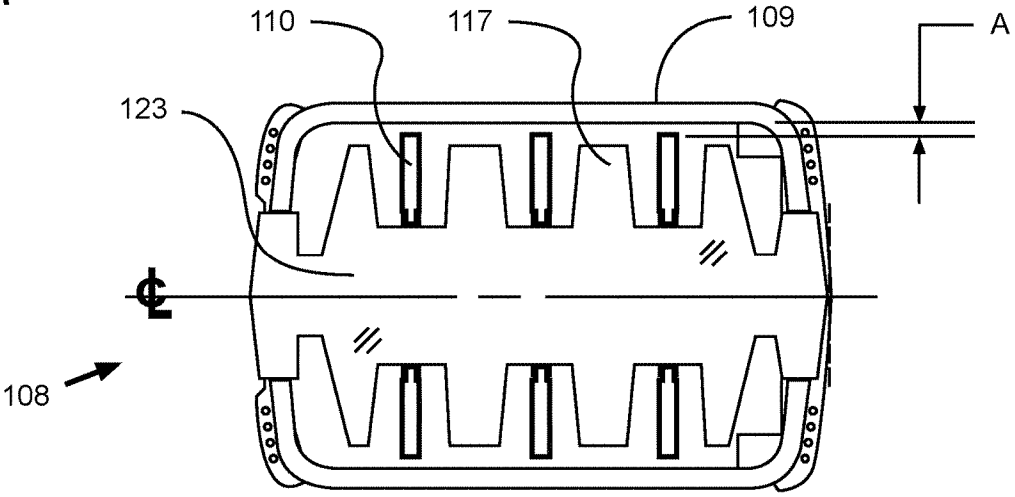
FIG. 7A is an exemplary diagram showing a top view of a slidable carriage providing an interposed inner carriage handle arrangement.

FIG. 7A is an exemplary diagram showing a top view of a slidable carriage 108 providing an interposed inner carriage handle 110 arrangement. More specifically, a plurality of inner carriage handles 110 are interposed between laterally projecting portions of a slidable carriage exercise platform 123. In the illustrated variation, the handles 110 are affixed to the structure of the slidable carriage 108, the length of the handles 110 being of a dimension that prevents the handles 110 from contacting the outer carriage handle 109. Therefore, a space "A" between the laterally projecting ends of the handles 110 and the outer carriage handle 109 provides for the exerciser 300 to grip the outer carriage handle 109 at any point without encountering obstructions.

Figure 7B:
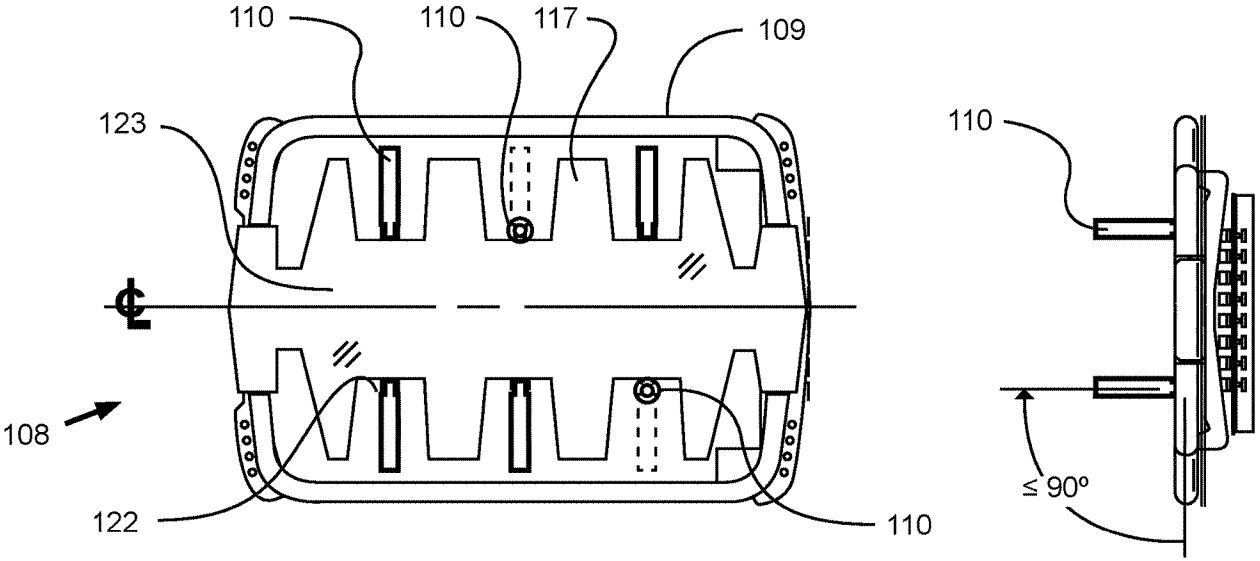
FIG. 7B is an exemplary diagram showing a top view of a slidable carriage providing an alternate interposed inner carriage handle arrangement.

FIG. 7B is an exemplary diagram showing a top view of a slidable carriage 108 providing an alternate interposed inner carriage handle 110 arrangement. In the alternate variation, a plurality of inner carriage handles 110 are interposed between laterally projecting portions 117 of a slidable carriage exercise platform 123, one or more handles 110 being rotatably affixed to a mounting yoke 122 such that the handle 110 is rotatable about an axis not shown, but which is aligned substantially parallel to the longitudinal central axis of the slidable carriage 108. As shown in the associated end views of the carriage 108, the one or more rotatable handles 110 with the central axis of the handles 110 being substantially coplanar with the top surface of the slidable carriage exercise platform 123, may be rotated so that the central axis of the handles 110 are substantially perpendicular to the plane of the top surface of the slidable carriage exercise platform 123.

The figures illustrate that the handles 110 may be rotatably adjusted about the yoke between a first, horizontal position and a second, vertical position. In some embodiments, the handles 110 may be rotated to alternate angles with respect to the slidable carriage exercise platform 123. For example, the handles 110 may be adjustable between any number of locked positions, including angular positions between horizontal and vertical.

Figure 7C:
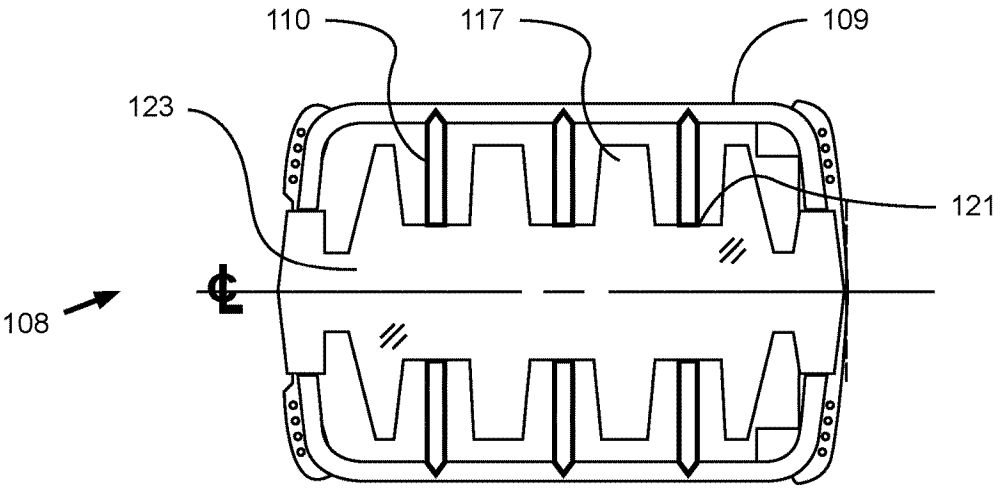
FIG. 7C is an exemplary diagram showing a top view of a slidable carriage providing another alternate interposed inner carriage handle arrangement.

FIG. 7C is an exemplary diagram showing a top view of a slidable carriage 108 providing another alternate interposed inner carriage handle 110 embodiment. More specifically, a plurality of inner carriage handles 110 are interposed between laterally projecting portions 117 of a slidable carriage exercise platform 123. In the alternative embodiment, a first end of each handle 110 is affixed to the outer carriage handle 109, with the second distal end of each handle 110 affixed at a point of secondary connection 121 with the slidable carriage exercise platform 123.

Figure 7D:
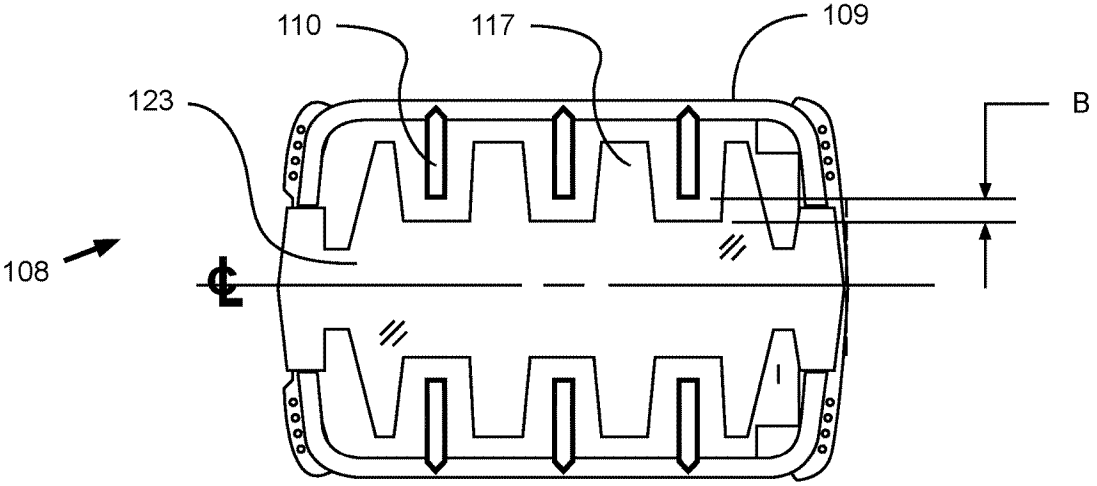
FIG. 7D is an exemplary diagram showing a top view of a slidable carriage providing yet another alternate interposed inner carriage handle arrangement.

FIG. 7D is an exemplary diagram showing a top view of a slidable carriage 108 providing yet another alternate interposed inner carriage handle 110 arrangement. In this alternate handle 110 variation, a plurality of inner carriage handles 110 are interposed between laterally projecting portions 117 of a slidable carriage exercise platform 123. In the variation, the handles 110 are affixed to the outer carriage handle 109, the length of the handles being of a dimension that prevents the handles from contacting the slidable carriage exercise platform 123. Therefore, a space "B" between the medially projecting ends of the transversely opposed handles 110 and the exercise platform 123 provides for the exerciser 300 to grip portions of the slidable carriage 108 otherwise inaccessible where the medial ends of the handles 110 would have been affixed to the exercise platform.

Figure 8A:
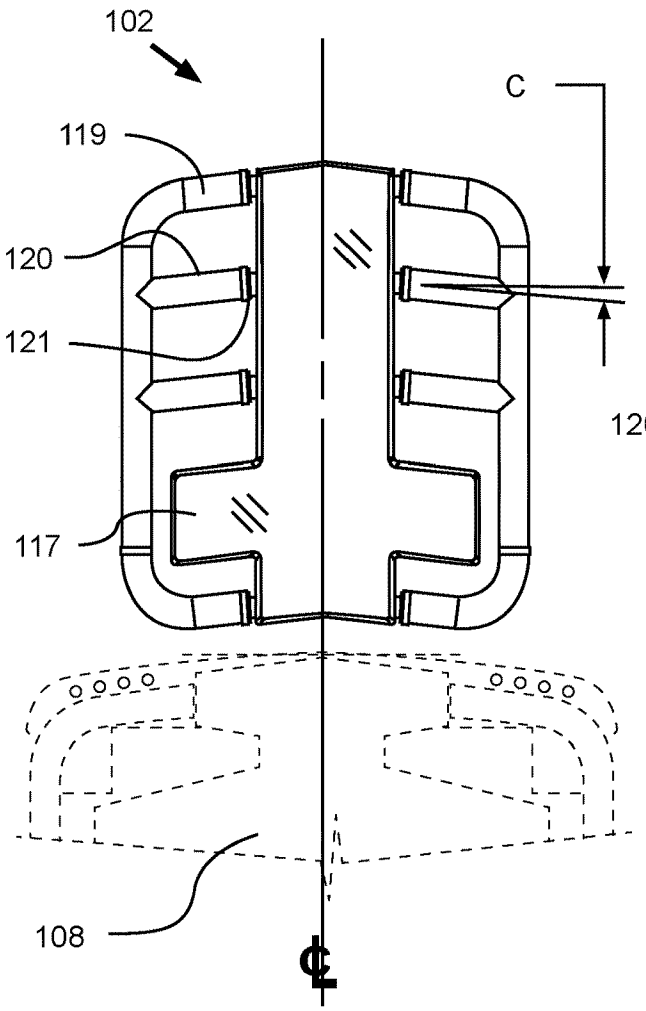
FIG. 8A is an exemplary diagram showing a top view of a first end stationary platform and a plurality of handles.

FIG. 8A is an exemplary diagram showing a top view of a first end stationary platform 102 and a plurality of platform handles 119, 120. A dashed outline of a portion of the slidable carriage 108 previously described is shown as a point of reference to identify the proximate and distal ends of the stationary platform 102.

In the drawing, laterally projecting portions 117 of the stationary platform 102 are shown proximate to the slidable carriage 108. A plurality of platform handles 120 are shown with the lateral ends of the handles 120 affixed to outer platform handles 119, and the medial ends of the handles 120 affixed to the exercise platform 102 at a secondary points of connection 121. The handles 120 are spaced apart from each other, and are spaced apart from the laterally projecting portion 117 of the exercise platform 102. The central axis of the handles 120 are preferably positioned at an acute angle "C" relative to the transverse axis of the platform 102 so that the medial ends of the handles 120 angle toward the distal end of the platform 102. The handle angle provides for a more natural and ergonomic positioning of the exerciser's hands when gripping the handles 120.

Figure 8B:
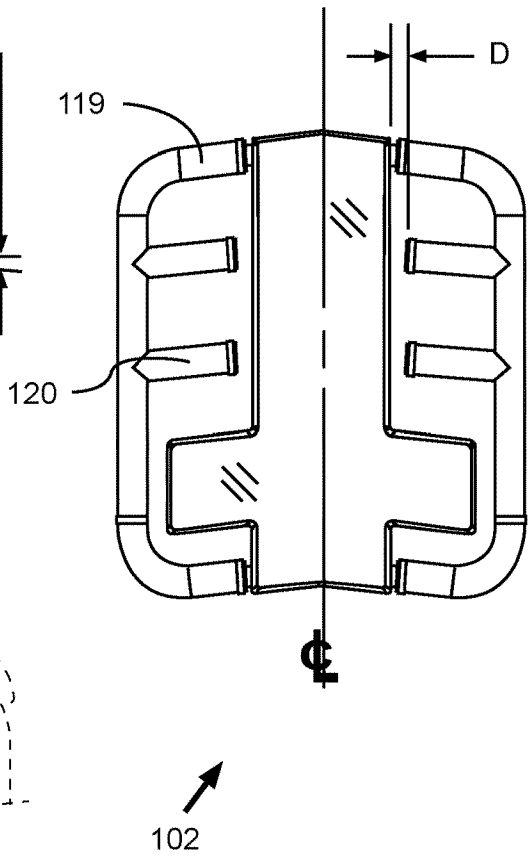
FIG. 8B an exemplary diagram showing a top view of a first end stationary platform and a first variation of a plurality of handles.

FIG. 8B an exemplary diagram showing a top view of a first end stationary platform 102 and a first variation of a plurality of handles 120.

In the drawing, a plurality of platform handles 120 are shown with the lateral ends of the handles 120 affixed to outer platform handles 119, the length of the handles 120 being of a dimension that prevents the handles 120 from contacting the exercise surface of the stationary platform 102. Therefore, a space "D" between the medially projecting ends of the transversely opposed handles 120 and the exercise platform 102 provides for the exerciser to grip portions of the exercise platform 102 otherwise inaccessible where the medial ends of the handles 120 would have been affixed to the exercise platform 102.

Figure 8C:
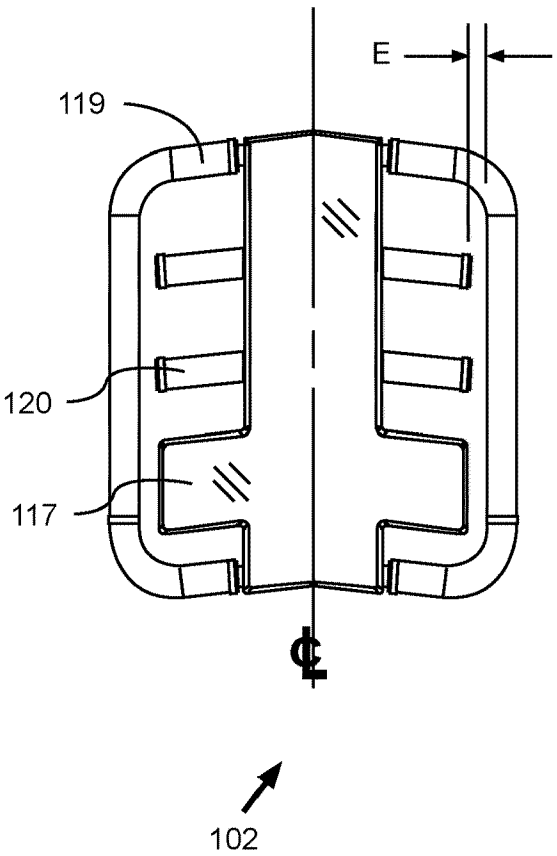
FIG. 8C an exemplary diagram showing a top view of a first end stationary platform and second variation of a plurality of handles.

FIG. 8C is an exemplary diagram showing a top view of a first end stationary platform 102 and second variation of a plurality of handles 120. As shown, a plurality of platform handles 120 are illustrated with the medial ends of the handles 120 affixed to the exercise platform 102, the length of the handles 120 being of a dimension that prevents the handles 120 from contacting the outer platform handle 119. Therefore, a space "E" between the laterally projecting ends of the transversely opposed handles 120 and the outer platform handle 119 provides for the exerciser 300 to grip any portion of the outer platform handle 119 otherwise inaccessible where the lateral ends of the handles 120 would have been affixed to the outer platform handle 119.

Figure 9:
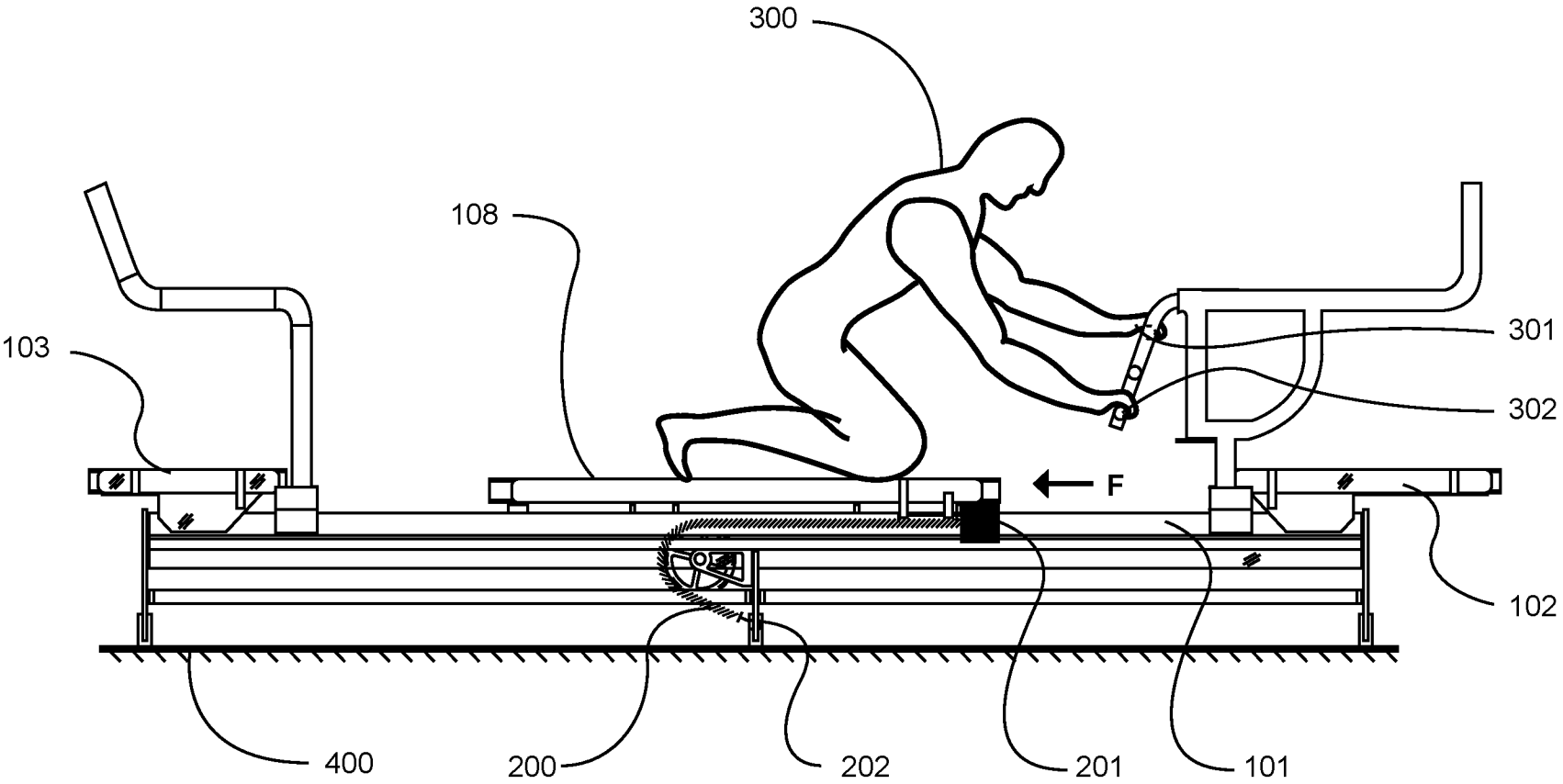
FIG. 9 is an exemplary diagram showing a side view of an exerciser gripping multiple handles on an embodiment of an exercise machine.

FIG. 9 is an exemplary diagram showing a side view of an exerciser gripping multiple gripping handles on an embodiment of an exercise machine positioned on a floor 400. In the drawing, an embodiment of an exercise machine comprises a first end stationary platform 102, a second end stationary platform 103 and a pair of parallel guide rails 101 extending substantially between the first end and second end stationary platforms 102, 103. A slidable carriage 108 is continuously repositionable along substantially the length of the parallel guide rails 101 as previously described. An exerciser 300 is shown positioned on the slidable carriage 108 in a representative posture to perform a certain upper body exercise.

As previously described, biasing members 200 may exert a resistance force against the slidable carriage 108. The biasing members 200 may be positioned between the parallel guide rails 101 and are typically not visible when viewing the side of the exercise machine. Merely for clarity, the proximate guide rail 101 has been removed in order to illustrate one method of how biasing members 200 may induce a resistance force against the slidable carriage 108.

Continuing to reference FIG. 9, a biasing member 200 is shown with one end affixed to a biasing member anchor gusset 202. The gusset 202 remains stationary relative to the machine structure. The opposed end of the biasing member 200 terminates at a biasing member selector 201. The selector 201 may be removably attached to the end of the slidable carriage 108 proximate to the first end stationary platform 102. As can be seen, the biasing member 200 wraps around a portion of a pulley, reversing the biasing direction, and thereby producing a pulling force "F" against the slidable carriage 108 in the direction indicated by the arrow. In order for an exerciser 300 to move the slidable carriage 108 in a direction opposed to the pulling force of the biasing member 200, the exerciser 300 grasps a stationary member of the exercise machine, and exerts a pulling or pushing force sufficient to overcome the biasing member force, thereby causing the slidable carriage 108 to move in a direction opposed to the direction of the biasing force.

It should be noted that the exercise machine just described may comprise a plurality of biasing members 200, any one or more of which may be removably attached between the stationary anchor gusset 202 and the slidable carriage 108 to produce the preferred total exercise resistance.

In the drawing, the exerciser is shown with a left hand 301 grasping an upper rung 112 of the first end left handle assembly 104 as previously described, and the right hand 302 grasping a lower rung 112 of the first end right handle assembly 105. In the work phase of the exercise cycle, the exerciser 300 moves the slidable carriage 108 in a direction toward the first end stationary platform 102 by progressively reaching forward with alternate hands to grasp additional rungs 112, handles 104, 105, 106, 107 and other stationary gripping surfaces of the handle assemblies, thereby exercising the arms, shoulders, back and other upper body muscles. During the rest phase of the exercise cycle, the exerciser 300 slowly returns the slidable carriage 108 in the same direction as the biasing force by reversing the alternate hand positioning just described.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine carriage and end platform handle system, suitable methods and materials are described above. All publications, patent applications, patents, and other references mentioned herein are incorporated by reference in their entirety to the extent allowed by applicable law and regulations. The exercise machine carriage and end platform handle system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

at least one rail having a first end and a second end, wherein the at least one rail has a longitudinal axis;

a carriage movably connected to the at least one rail and adapted to be moveable along a portion of the longitudinal axis of the at least one rail; and a first handle extending from the carriage, wherein the first handle is pivotably adjustable between a first position and a second position, whereby a free end of the first handle is respectively moved away from and toward a longitudinal central axis of the carriage.

2. The exercise machine of claim 1, wherein the first handle is comprised of a first end and a second end, wherein the first end of the first handle is connected to the carriage, and wherein the second end of the first handle is the free end of the first handle.

3. The exercise machine of claim 1, further comprising an outer carriage handle connected to the carriage, wherein the outer carriage handle substantially encircles the carriage.

4. The exercise machine of claim 1, wherein the first position comprises a horizontal position and wherein the second position comprises a vertical position.

5. The exercise machine of claim 1, wherein the carriage comprises a yoke, wherein the first handle is pivotably connected to the yoke.

6. The exercise machine of claim 1, further comprising a handle assembly connected at or near the first end of the at least one rail, wherein the handle assembly comprises a ladder rail including a plurality of rungs.

7. The exercise machine of claim 1, further comprising an end platform connected at or near the first end or the second end of the at least one rail.

8. An exercise machine, comprising:

at least one rail having a first end and a second end;

a carriage movably connected to the at least one rail and adapted to be moveable along a portion of the at least one rail;

a first handle extending from the carriage, wherein the first handle is pivotably adjustable between a first position and a second position, whereby a free end of the first handle is respectively moved away from and toward a longitudinal central axis of the carriage; and a second handle extending from the carriage, wherein the second handle is pivotably adjustable between a first position and a second position, whereby a free end of the second handle is respectively moved away from and toward the longitudinal central axis of the carriage.

9. The exercise machine of claim 8, further comprising a third handle extending from the carriage and a fourth handle extending from the carriage, wherein the third handle and the fourth handle are each adjustable between a first position and a second position.

10. The exercise machine of claim 9, wherein the first position for the first handle, the second handle, the third handle and the fourth handle comprises a horizontal position, and wherein the second position for the first handle, the second handle, the third handle and the fourth handle comprises a vertical position.

11. The exercise machine of claim 8, wherein the first position for the first handle and the second handle comprises a horizontal position, and wherein the second position for the first handle and the second handle comprises a vertical position.

12. The exercise machine of claim 8, wherein the first handle is comprised of a first end and a second end, wherein the first end of the first handle is connected to the carriage, wherein the second end of the first handle is the free end of the first handle, wherein the second handle is comprised of a first end and a second end, wherein the first end of the second handle is connected to the carriage, and wherein the second end of the second handle is the free end of the second handle.

13. The exercise machine of claim 8, wherein the carriage comprises a first yoke and a second yoke, wherein the first handle is pivotably connected to the first yoke and the second handle is pivotally connected to the second yoke.

14. The exercise machine of claim 8, further comprising an end platform connected at or near the first end or the second end of the at least one rail.

15. An exercise machine, comprising:

at least one rail having a first end and a second end;

a carriage movably connected to the at least one rail and adapted to be moveable along a portion of the at least one rail;

a first handle extending from the carriage, wherein the first handle is pivotably adjustable between a first position and a second position, whereby a free end of the first handle is respectively moved away from and toward a longitudinal central axis of the carriage; and a second handle extending from the carriage, wherein the second handle is pivotably adjustable between a first position and a second position, whereby a free end of the second handle is respectively moved away from and toward the longitudinal central axis of the carriage;

wherein the free end of the first handle is respectively moved away from and toward the second handle, and wherein the free end of the second handle is respectively moved away from and toward the first handle.

16. The exercise machine of claim 15, further comprising a third handle extending from the carriage and a fourth handle extending from the carriage, wherein the third handle and the fourth handle are each adjustable between a first position and a second position.

17. The exercise machine of claim 15, wherein the first position for the first handle and the second handle comprises a horizontal position, and wherein the second position for the first handle and the second handle comprises a vertical position.

18. The exercise machine of claim 15, wherein the first handle is comprised of a first end and a second end, wherein the first end of the first handle is connected to the carriage, wherein the second end of the first handle is the free end of the first handle, wherein the second handle is comprised of a first end and a second end, wherein the first end of the second handle is connected to the carriage, and wherein the second end of the second handle is the free end of the second handle.

19. The exercise machine of claim 15, wherein the carriage comprises a first yoke and a second yoke, wherein the first handle is pivotably connected to the first yoke and the second handle is pivotally connected to the second yoke.

20. The exercise machine of claim 15, further comprising a first end platform connected at or near the first end of the at least one rail and a second end platform connected at or near the second end of the at least one rail.

* * * * *